US010787754B2

(12) United States Patent
Qiao et al.

(10) Patent No.: US 10,787,754 B2
(45) Date of Patent: Sep. 29, 2020

(54) POLYMER/FILLER/METAL COMPOSITE FIBER AND PREPARATION METHOD THEREOF

(71) Applicants: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

(72) Inventors: Jinliang Qiao, Beijing (CN); Yilei Zhu, Beijing (CN); Xiaohong Zhang, Beijing (CN); Liangshi Wang, Beijing (CN); Chuanlun Cai, Beijing (CN); Guicun Qi, Beijing (CN); Hongbin Zhang, Bejing (CN); Zhihai Song, Beijing (CN); Jinmei Lai, Beijing (CN); Binghai Li, Beijing (CN); Ya Wang, Beijing (CN); Xiang Wang, Beijing (CN); Jianming Gao, Beijing (CN); Gang Chen, Beijing (CN); Haibin Jiang, Beijing (CN)

(73) Assignees: China Petroleum & Chemical Corporation, Beijing (CN); Beijing Research Institute of Chemical Industry, China Petroleum & Chemical Corporation, Beijing (CN)

( * ) Notice: Subject to any disclaimer, the term of this patent is extended or adjusted under 35 U.S.C. 154(b) by 976 days.

(21) Appl. No.: 14/783,813

(22) PCT Filed: Apr. 11, 2014

(86) PCT No.: PCT/CN2014/075168
§ 371 (c)(1),
(2) Date: Oct. 9, 2015

(87) PCT Pub. No.: WO2014/166420
PCT Pub. Date: Oct. 16, 2014

(65) Prior Publication Data

US 2016/0122908 A1 May 5, 2016

(30) Foreign Application Priority Data

Apr. 12, 2013 (CN) ..... 2013 1 0127922
Apr. 12, 2013 (CN) ..... 2013 1 0127994
(Continued)

(51) Int. Cl.
*D01F 8/18* (2006.01)
*D01D 5/12* (2006.01)
(Continued)

(52) U.S. Cl.
CPC ..... *D01F 8/18* (2013.01); *D01D 5/12* (2013.01); *D01F 1/09* (2013.01); *D01F 1/10* (2013.01);
(Continued)

(58) Field of Classification Search
CPC .. C08K 3/04–046; C08K 3/0075–0091; C08K 3/08; C08K 3/10–14; C08K 3/22;
(Continued)

(56) References Cited

U.S. PATENT DOCUMENTS 3,001,265 A * 9/1961 Bundy ..... D01D 5/34 428/373
4,639,396 A * 1/1987 Semsarzadeh ..... C08K 3/08 252/503
(Continued)

FOREIGN PATENT DOCUMENTS

CN 1914694 A 2/2007
CN 101827894 A 9/2010
(Continued)

OTHER PUBLICATIONS

Machine Translation of JP 2004-316029.*
(Continued)

*Primary Examiner* — Shawn Mckinnon
(74) *Attorney, Agent, or Firm* — Duane Morris LLP

(57) ABSTRACT

The present invention relates to a polymer/filler/metal composite fiber, including a polymer fiber comprising a metal short fiber and a filler; the metal short fiber is distributed as a dispersed phase within the polymer fiber and distributed in parallel to the axis of the polymer fiber; the filler is dispersed
(Continued)

within the polymer fiber and distributed between the metal short fibers; the filler does not melt at the processing temperature of the polymer; said metal is a low melting point metal and selected from at least one of single component metals and metal alloys, and has a melting point which ranges from 20 to 480° C., and, at the same time, which is lower than the processing temperature of the polymer; the metal short fiber and the polymer fiber have a volume ratio of from 0.01:100 to 20:100; the filler and the polymer have a weight ratio of from 0.1:100 to 30:100. The composite fiber of the present invention has reduced volume resistivity and decreased probability of broken fibers, and has a smooth surface. The present invention is simple to produce, has a lower cost, and would be easy to industrially produce in mass.

32 Claims, 1 Drawing Sheet

(30) Foreign Application Priority Data

Apr. 12, 2013 (CN) ..... 2013 1 0128099
Apr. 12, 2013 (CN) ..... 2013 1 0128100
Apr. 12, 2013 (CN) ..... 2013 1 0128266

(51) Int. Cl.
*D01F 8/14* (2006.01)
*D01F 8/06* (2006.01)
*D01F 8/12* (2006.01)
*D01F 1/09* (2006.01)
*D01F 1/10* (2006.01)

(52) U.S. Cl.
CPC ..... *D01F 8/06* (2013.01); *D01F 8/12* (2013.01); *D01F 8/14* (2013.01); *D10B 2101/20* (2013.01)

(58) Field of Classification Search
CPC ..... C08K 3/2279; C08K 2003/0806–0893; C08K 2003/2203–2275; C08K 2003/2282–2296; C08J 5/041; C08J 5/042; D10B 2101/20; D10B 2101/12; D10B 2101/122; D01F 8/00; D01F 8/04–16
USPC ..... 428/364–401
See application file for complete search history.

(56) References Cited

U.S. PATENT DOCUMENTS

| | | | | |
|---|---|---|---|---|
| 5,928,785 | A | 7/1999 | Nishida et al. | |
| 6,184,280 | B1 * | 2/2001 | Shibuta | H01B 1/20 252/518.1 |
| 7,026,049 | B2 * | 4/2006 | Endo | D01F 1/09 264/185 |
| 2007/0213450 | A1 * | 9/2007 | Winey | B82Y 30/00 524/495 |
| 2010/0140534 | A1 | 6/2010 | Kim et al. | |
| 2010/0204380 | A1 * | 8/2010 | Kim | C08J 5/041 524/440 |
| 2011/0173873 | A1 * | 7/2011 | Nakanishi | A01K 91/00 43/44.98 |

FOREIGN PATENT DOCUMENTS

| | | | |
|---|---|---|---|
| CN | 102409421 | A | 4/2012 |
| JP | 2797529 | B | 5/1991 |
| JP | 2004316029 | A | 11/2004 |
| JP | 2004316029 | A | 11/2004 |
| JP | 2006022130 | | 1/2006 |
| KR | 100337267 | B1 | 2/2007 |
| KR | 1020090134873 | | 12/2009 |
| KR | 20110078416 | A | 7/2011 |
| WO | 2006023860 | A3 | 3/2006 |
| WO | 2010/019746 | A2 | 2/2010 |

OTHER PUBLICATIONS

Sheehan, W. C. Relationship between molecular orientation and draw ratio of polypropylene monofilaments. J. Appl. Polym. Sci., 9: 3597-3603. doi: 10.1002/app.1965.070091109 (Year: 1965).*
Extended European Search Report for EP Patent Application No. 14782688 dated Aug. 11, 2017.
Zhu, Yan Lei, "New Principles of Method and Preparation of Electrical Conductive/Antistatic Fiber," China Academic Journal Electronic Publishing House, 1994-2015.
Sun, Yiming, "Study on Electrical Conductivity of HDPE Filled With Low Melting Point Dual Component Alloy," China Academic Journal Electronic Publishing House, 1994-2012.
Zhu, Tanglei, "Preparation and Properties of Conductive/Anti-static Polymer Nanocomposites", Doctoral Dissertations of Beijing University of Chemical Technology, Aug. 8, 2103, sections 2.2 and 2.5.
International Search Report for International Application No. PCT/CN2014/075168, dated Aug. 4, 2014.
Written Opinion for International Application No. PCT/CN2014/075168, dated Aug. 4, 2014.
International Preliminary Report on Patentability or International Application No. PCT/CN2014/075168, dated Oct. 13, 2015.

* cited by examiner

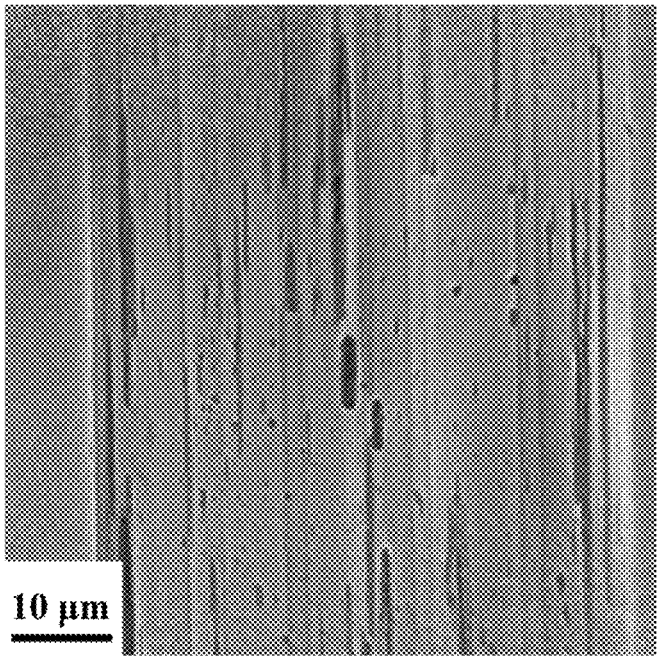
10 μm

POLYMER/FILLER/METAL COMPOSITE FIBER AND PREPARATION METHOD THEREOF

TECHNICAL FIELD

This application claims priority to International Application No. PCT/CN2014/075168, filed on Apr. 11, 2014, which in turn claims the benefit of Chinese Patent Application No. 201310127922.4, No. 201310128100.8, No. 201310128099.9, No. 201310127994.9, and No. 201310128266.X, all filed Apr. 12, 2013.

The present invention relates to the field of synthetic fibers. Specifically, the present invention relates to a polymer/filler/metal composite fiber and a process for preparing the same, and relates to the corresponding polymer/filler/metal blend.

BACKGROUND ART

Compared with natural fibers, synthetic fibers have such characteristics as low price, low density and low moisture absorption, and they are widely used in the fields such as textiles and clothing, and woven bags in daily production and life. However, synthetic fibers have good electrical insulation property and high resistivity, trend to produce static electricity during their application, and thus will bring harm to both industrial production and human's life. Moreover, with the high-tech development, static electricity and electrostatic dust adsorption is one of the direct causes for modern electronic equipment operation failure, short circuit, signal loss, bit error, and low yield. In petroleum, chemical engineering, precision machinery, coal mine, food, medicine and other industries, there are special requirements on the electrostatic protection. Therefore, the development of fibers with superior electrical properties to thereby reduce the harm caused by static electricity becomes a very urgent subject.

Carbon nanotubes are curled graphite-like nanoscale tubular structures constituted by six-membered carbon rings. Since carbon nanotubes have excellent electrical and mechanical properties, they are widely used in the field of polymer-based composites or composite fibers. However, due to the high surface energy of nanoparticles per se, carbon nanotubes have serious agglomeration effect, thereby leading to increased filling amount of nanoparticles and cost. Meanwhile, filling of a large amount of nanoparticles causes difficulties to fiber production as well. How to reduce the amount of carbon nanotubes and reduce production difficulties is the problem which is urgent to be solved.

Adding a third component with the composite conductive filler technique is an effective method for effectively improving the conductive efficiency of fibers, and reducing the content of carbon nanotubes. The patent application CN102409421A discloses a process for preparing polypropylene/nano tin dioxide/carbon nanotube-composite fibers. The technique reduces the resistivity of the composite fiber, but the third component as added is also a nanoparticle, leading to increase in the processing difficulty of raw materials, rough fiber surface, bad hand feel, decreased mechanical properties, and easily broken fibers during production and so on.

In recent years, there occurs new development in the field of polymer/low melting point metal composite materials both at home and abroad. Due to high conductivity, easy processing and other characteristics, low melting point metal, as a new filler, is widely used in the field of polymer composite materials. The patent application CN102021671A discloses a polymer/low melting point metal composite wire and its manufacturing method, and the patent application CN102140707A discloses a skin-core composite electromagnetic shielding fiber and its preparation method thereof. The above-described two techniques relate to the process for preparing polymer-sheathed low melting point metal wires or fibers using the skin-core composite technique. However, the techniques require special composite spinning machine, and the proportion of the metal as the core layer of fibers increases. Although the techniques ensure relatively low resistivity of the fibers, they require the addition of the metal in a large amount, which increases the production cost.

DISCLOSURE

The present invention is presented for the purpose that a composite fiber having a low volume resistivity and good hand feel (smooth fiber surface) can be prepared in a simple and low cost process.

An object of the present invention is to provide a polymer/filler/metal composite fiber having good antistatic properties and hand feel.

Another object of the present invention is to provide a process for preparing the above-mentioned polymer/filler/metal composite fiber. By the process, the polymer/filler/metal composite fiber is prepared by an in-situ process, namely the preparation process where during the preparation of the polymer fiber, the low melting point metal as dispersed phase is drawn and deformed from metal particles into a metal short fiber. Due to the presence of the filler in the system, the viscosity of the system increases greatly during blending. Under the condition of the same shear rate, the system is subjected to a greater shearing action, so that the low melting point metal has smaller dispersed particle size in the matrix of the polymer material. On the other hand, this also reduces the probability of recombination of metal particles after collision, leading to smaller particle size of the metal particles, a larger number of metal particles and smaller distance between the metal particles. Thus, when the metal particles are in-situ deformed into metal fibers, the short fibers have smaller diameter and smaller distance therebetween. Further, in the case of a conductive filler (e.g. carbon nanotubes), the conductive filler dispersed between the metal fibers also has an effect of connection, to thereby achieve the object of improving antistatic properties of the fibers with lower metal filling amount. The process of the present invention is conducted in the existing common equipment for fiber production, so that the preparation process has good applicability and lower equipment cost.

The polymer/filler/metal composite fiber of the present invention includes a polymer fiber comprising a filler and a metal short fiber, whose microstructure is that the metal short fiber is distributed as a dispersed phase within the polymer fiber, and the metal short fiber as dispersed phase is distributed in parallel to the axis of the polymer fiber; the filler is dispersed within the polymer fiber and is distributed between the metal short fibers. Due to the presence of the filler, short fibers have a smaller diameter and a shorter distance therebetween. In addition, in the case of a conductive filler (e.g. carbon nanotubes), the conductive filler also acts to connect the metal short fibers, and thus a conductive network is easier to form, so that antistatic property of the composite fiber as prepared is improved, and a good hand feel of the fiber is maintained.

Within the scope of the present invention, the "distributed in parallel" means that metal short fibers are oriented in parallel to the axis of the polymer fiber. Nevertheless, as determined by the preparation process of the composite fiber (e.g., drawing process), it is possible that a small number of metal short fibers are oriented at a certain angle from the axis of the polymer fiber, and the "distributed in parallel" described in the present invention also encompasses such circumstance.

In the polymer/filler/metal composite fiber of the present invention, the polymer of the polymer fiber is a thermoplastic resin, preferably a thermoplastic resin having a melting point in the range of from 90 to 450° C., and more preferably a thermoplastic resin having a melting point in the range of from 100 to 290° C., and most preferably is selected from one of polyethylene, polypropylene, polyamide or polyester, etc. The polyamide includes any kind of spinnable polyamides in the prior art, preferably nylon 6, nylon 66, nylon 11 or nylon 12. The polyester can be any spinnable polyester in the prior art, preferably polyethylene terephthalate (PET) or polytrimethylene terephthalate (PTT).

The filler in the polymer/filler/metal composite fiber of the present invention is the filler that does not melt at the processing temperature of the polymer. In the present invention, there is no limitation on the shape of the filler. The filler can be of any shape, and can be spherical or spherical-like, ellipsoidal, linear, needle shaped, fiber shaped, rod-like, sheet-like, etc. The size of these fillers is not limited at all, as long as they can be dispersed in the polymer matrix and are smaller than the diameter of the fibers finally prepared. The filler with at least one dimension of the three dimensions of less than 500 μm, preferably less than 300 μm, is preferred; the prior art nanoscale filler is more preferred, namely, the filler whose zero-dimensional, one-dimensional or two-dimensional size can achieve nano size, preferably the filler whose 1 or 2-dimensional size can reach nano size. Where zero-dimensional nanoscale filler is just spherical or spherical-like filler whose diameter is preferably of nanoscale; 1-dimensional nano material is just the linear, needle shaped, fiber shaped and otherwise shaped filler whose radial size is of nanoscale; and 2-dimensional nano material is the sheet-like filler whose thickness is of nanoscale. The so-called nanoscale size generally refers to the size of less than 100 nm, but for some known nanoscale fillers in the prior art, such as carbon nanotubes, although their diameter size ranges from several tens of nanometers to several hundred nanometers, they are customarily recognized as of nanoscale. For another example, nanoscale calcium sulfate whisker generally has an average diameter of a few hundred nanometers, but it also customarily recognized as of nanoscale. Thus the nano-sized filler in the present invention herein refers to the customarily recognized nanoscale fillers in the prior art. The nanoscale filler more preferably has at least one dimension of its three dimensions of less than 100 nm, most preferably less than 50 nm.

The filler in the polymer/filler/metal composite fiber of the present invention may be a conductive filler and/or a non-conductive filler. The conductive filler and the non-conductive filler may be any kind of various conductive and non-conductive fillers as disclosed in the prior art. Generally, powder resistivity is used as an indicator in the prior art to distinguish the non-conductive filler from the conductive filler, wherein the filler having powder resistivity of less than $1\times10^9$ Ω·cm is known as a conductive filler, and the filler having powder resistivity greater than or equal to $1\times10^9$ Ω·cm is known as a non-conductive filler.

The conductive filler in the polymer/filler/metal composite fiber of the present invention is preferably at least one of single component metals, metal alloys, metal oxides, metal salts, metal nitrides, nonmetallic nitrides, metal hydroxides, conductive polymers, conductive carbon materials, and more preferably at least one of gold, silver, copper, iron, gold alloys, silver alloys, copper alloys, iron alloys, titanium dioxide, ferric oxide, ferroferric oxide, silver oxides, zinc oxides, carbon black, carbon nanotubes, graphene and linear conductive polyaniline.

In one embodiment, the filler in the polymer/filler/metal composite fiber of the present invention is a carbon nanotube. The carbon nanotube may be any kind of carbon nanotubes in the prior art, and it is generally selected from at least one of single-walled carbon nanotubes, double-walled carbon nanotubes, and multi-walled carbon nanotubes, preferably from multi-walled carbon nanotubes. The carbon nanotube has a diameter of from 0.4 to 500 nm, a length of from 0.1 to 1000 μm, and an aspect ratio of from 0.25 to $2.5\times10^6$, preferably has a diameter of from 1 to 50 nm, a length of from 1 to 50 μm, and an aspect ratio of from 1 to $1\times10^3$.

The non-conductive filler in the polymer/filler/metal composite fiber of the present invention is preferably at least one of non-conductive metal salts, metal nitrides, nonmetallic nitrides, nonmetallic carbides, metal hydroxides, metal oxides, non-metal oxides, and natural ores, more preferably at least one of calcium carbonate, barium sulfate, calcium sulfate, silver chloride, aluminum hydroxide, magnesium hydroxide, alumina, magnesia, silica, asbestos, talc, kaolin, mica, feldspar, wollastonite and montmorillonite.

In one embodiment, the filler in the polymer/filler/metal composite fiber of the present invention is a montmorillonite. The montmorillonite may be any kind of montmorillonites as disclosed in the prior art, generally including non-modified pure montmorillonites and/or organically modified montmorillonites in the prior art, and it is preferably an organically modified montmorillonite.

The non-modified pure montmorillonite can be classified into non-acidic montmorillonite and acidic montmorillonite according to the different pH value of the suspension obtained by dispersing the montmorillonite in water. The non-modified pure montmorillonite in the present invention is preferably at least one of sodium-based non-modified pure montmorillonite, calcium-based non-modified pure montmorillonite, magnesium-based non-modified pure montmorillonite, acidic calcium-based non-modified pure montmorillonite, aluminum-based non-modified pure montmorillonite, sodium calcium-based non-modified pure montmorillonite, calcium sodium-based non-modified pure montmorillonite, sodium magnesium-based non-modified pure montmorillonite, magnesium sodium-based non-modified pure montmorillonite, sodium aluminum-based non-modified pure montmorillonite, aluminum sodium-based non-modified pure montmorillonite, magnesium calcium-based non-modified pure montmorillonite, calcium magnesium-based non-modified pure montmorillonite, calcium aluminum-based non-modified pure montmorillonite, aluminum calcium-based non-modified pure montmorillonite, magnesium aluminum-based non-modified pure montmorillonite, aluminum magnesium-based non-modified pure montmorillonite, calcium magnesium aluminum-based non-modified pure montmorillonite, magnesium calcium aluminum-based non-modified pure montmorillonite, sodium magnesium calcium-based non-modified pure montmorillonite, and calcium magnesium sodium-based non-modified pure montmorillonite.

The organically modified montmorillonite is selected from the organically modified montmorillonite obtained by ion exchange reaction between a cationic surfactant and exchangeable cations between the clay lamellae, and/or the organically modified montmorillonite obtained by a grafting reaction between a modifier and the active hydroxyl at the surface of the clay, preferably at least one of an organic quaternary ammonium salt modified montmorillonite, a quaternary phosphonium salt modified montmorillonite, silicone-modified montmorillonite, siloxane-modified montmorillonite, and amine modified montmorillonite.

The polymer/filler/metal composite fiber of the present invention has a weight ratio of the filler to the polymer fiber in the range of from 0.1:100 to 30:100, preferably from 0.5:100 to 10:100, and more preferably from 1:100 to 2:100.

The metal of the metal short fibers in the polymer/filler/metal composite fiber of the present invention is a low melting point metal, i.e., at least one of single component metals and metal alloys having a melting point of from 20 to 480° C., preferably from 100 to 250° C., more preferably from 120 to 230° C., and at the same time has the melting point lower than the processing temperature of the polymer.

Preferably, the single component metal as the metal is the elemental metal of gallium, cesium, rubidium, indium, tin, bismuth, cadmium, and lead element; and the metal alloy as the metal is the metal alloy of two or more of gallium, cesium, rubidium, indium, tin, bismuth, cadmium and lead elements, such as tin-bismuth alloy, or the metal alloy of at least one of gallium, cesium, rubidium, indium, tin, bismuth, cadmium and lead elements and at least one of copper, silver, gold, iron and zinc elements, or the alloy formed by at least one of gallium, cesium, rubidium, indium, tin, bismuth, cadmium and lead elements, at least one in elements of copper, silver, gold, iron, and zinc elements, and at least one selected from silicon element and carbon element.

The polymer/filler/metal composite fiber of the present invention has a volume ratio of the metal short fiber to the polymer fiber in the range of from 0.01:100 to 20:100, preferably from 0.1:100 to 4:100, and more preferably from 0.5:100 to 2:100.

In the polymer/filler/metal composite fiber of the present invention, the metal short fiber dispersed in the polymer fiber has a diameter of preferably less than or equal to 12 μm, more preferably less than or equal to 8 μm, and most preferably less than or equal to 3 μm.

The process for preparing the polymer/filler/metal composite fiber of the present invention comprises the following steps:

Step 1: melt blending the components including the polymer, the filler and the metal in given amounts to obtain a polymer/filler/metal blend.

Herein, said melt blending uses conventional processing conditions for melt blending of thermoplastic resins.

Micro-morphology of the resulting polymer/filler/metal blend is that the metal, as dispersed phase, is homogeneously distributed in the polymer matrix (the thermoplastic resin) as a continuous phase. The filler is dispersed between the metal particles. Due to the presence of the filler in the system, the viscosity of the blend system is greatly increased. Under the condition of the same shear rate, the system is subjected to a greater shearing action, so that the low melting point metal has smaller dispersed particle size in the polymer matrix. On the other hand, this also reduces the probability of recombination of metal particles after collision, leading to smaller particle size of the metal particles, greater number of metal particles and smaller distance between the metal particles.

Step 2: spinning the polymer/filler/metal blend obtained in step 1 in a spinning device to obtain a polymer/filler/metal composite precursor fiber.

Herein, said spinning device is the spinning device commonly used in the prior art. Under the usual spinning conditions for spinning the thermoplastic resin used, the usual spinning and winding speed is used for spinning. Typically, the faster the winding speed is, the smaller the diameter of the resulting composite fiber is, wherein the smaller the diameter of the metal short fiber is, the better the electrical properties of the final resulting composite fiber will be.

Step 3: drawing the polymer/filler/metal composite precursor fiber obtained in step 2 while heating within a range of the temperature lower than the melting point of the polymer used and higher than or equal to the melting point of the low melting point metal to obtain the polymer/filler/metal composite fiber.

Herein, drawing while heating uses usual draw ratio, which is preferably greater than or equal to 2 times, more preferably greater than or equal to 5 times, and most preferably greater than or equal to 10 times. With the increase of the draw ratio, the diameter of the metal short fibers becomes smaller, and the electrical properties of the composite fiber are improved. Meanwhile, due to the presence of the filler in the system, the particle size of the metal particles of the dispersed phase of the polymer/filler/metal blend obtained in step 1 becomes smaller, the number of metal particles becomes greater and the distance between the metal particles becomes smaller. Thus, in the resulting composite fiber after step 2 and step 3, the metal short fibers have a smaller diameter, and the distance between the metal short fibers is smaller, so that the electrical properties of the composite fiber are better.

The process for melt blending the polymer, the filler and the metal employed in step 1 of the process for preparing the polymer/filler/metal composite fiber of the present invention is the common melt blending process in rubber and plastics processing, and the blending temperature is the usual processing temperature of the thermoplastic resin, i.e., it should be selected within the range which ensures a complete melting of the thermoplastic resin and the metal as used while not leading to decomposition of the thermoplastic resin as used. In addition, according to the processing needs, a suitable amount of conventional additives for the processing of thermoplastic resins may be added to the blending material. During blending, the thermoplastic resin, the filler and the metal and other various components may be added simultaneously to the melt blending equipment via metering or other means for melt blending; it is also possible to first mix the various components homogeneously beforehand via a common mixing equipment, and then melt blend them via a rubber and plastics blending equipment.

The rubber and plastics blending equipment used in step 1 of the preparation process can be an open mill, an internal mixer, a single-screw extruder, a twin-screw extruder or a torque rheometer, etc. The material mixing equipment is selected from the mechanical mixing equipment in the prior art such as a high-speed stirrer, a kneader and the like.

In step 1 of the preparation process, the raw materials may further comprise additives commonly used in the plastics processing field, such as antioxidants, plasticizers and other processing additives. The amount of these common additives is conventional amount, or can be appropriately adjusted according to the actual circumstance.

The drawing while heating in step 3 of the process for preparing the composite fiber of the present invention is the essential condition to ensure the obtaining of the polymer/filler/metal composite fiber of the present invention. In step 1, due to the presence of the filler in the system, the viscosity of the blend system increases greatly. Under the condition of the same shear rate, the system is subjected to a greater shearing action, so that the dispersed particle size of the low melting point metal in the polymer matrix becomes smaller. On the other hand, this also reduces the probability of recombination of metal particles after collision, leading to smaller particle size of the metal particles, greater number of metal particles and smaller distance between the metal particles. This guarantees the obtaining of the polymer/filler/metal composite fiber of the present invention. The micromorphology of the polymer/filler/metal composite fiber so obtained is that the metal short fibers are distributed as a dispersed phase within the polymer fiber, and the metal short fibers as the dispersed phase are distributed in parallel to the axis of the polymer fiber; the filler is dispersed between the metal short fibers. Due to the presence of the filler, the short fibers have a smaller diameter and a shorter distance therebetween. In addition, in the case of a conductive filler (e.g. carbon nanotubes), the conductive filler additionally has an effect of connection, and thus a conductive network is easier to form, so that antistatic property of the fiber as prepared is improved, and a good hand feel of the fiber is maintained. Meanwhile, since the metal short fibers are arranged inside the polymer fiber, this protects the metal short fibers from such damages when bending, stretching, folding, wearing and washing, and solves the problems of easy oxidation and easy exfoliation of the surface of the metal layer, or easy agglomeration of metal powders, thereby leading to the decreased antistatic effect. Further, the addition of the metal solves the problem of difficult spinning of the polymer/filler composite fiber. The spinning process is very smooth, and broken fibers are reduced significantly.

In particular, when preparing the conductive fibers in the prior art, the distance between the conductive fillers increases and the original conductive network is destroyed by drawing, with the increase in draw ratio. Therefore, under the condition that the conductive filler is determined, with the increase in draw ratio of the conductive fibers in the prior art, although the strength at break of the fibers increases, the electrical properties trend to decrease. In the present invention, the metal is drawn at an appropriate temperature, and then the metal will become longer with drawing. Moreover, in a plane perpendicular to the axis of the fiber, with the increase of the draw ratio, the distance between the metal fibers decreases continuously. In addition, in the case of the conductive filler (e.g. carbon nanotubes), the conductive filler also has an effect of connection, thus a conductive network is easier to form. Such special structure results in that, with the increase in the draw ratio, the internal conductive network of the composite fiber of the present invention becomes continuously improved, so that the electrical properties of the composite fiber of the present invention continue to improve. Thus, with the increase in the draw ratio and the increase in the strength at break, the electrical properties of the composite fiber of the present invention are not affected, but are improved herewith, to thereby achieve the object of simultaneously improving the mechanical properties and electrical properties of the composite fiber of the present invention.

The present invention proposes to adopt a common spinning device for producing an antistatic polymer/filler/metal composite fiber, which significantly reduces costs, and has wide applicability. The low melting point metal used in the polymer/filler/metal composite fiber of the present invention can improve the processability during the pelletization and the spinning performance of the fiber during the spinning, increase production efficiency, and reduce production costs. Moreover, by selecting the thermoplastic resin and the metal with the difference between their melting points in a wide range for use in combination, production conditions can be broadened, thereby to make the production easy.

DESCRIPTION OF THE DRAWINGS

The FIGURE is a nano X-ray tomography (Nano-CT) photo of the polymer/carbon nanotube/metal composite fiber prepared in Example 5. Under transmission mode, the black long strip-shaped substances in the FIGURE are metal fibers, and the offwhite cylindrical substance is the polymer fiber. The metal fibers are arranged in parallel in the drawing direction of the composite fiber.

EXAMPLES

The present invention is further described below in combination with the examples. The scope of the present invention is not limited by these examples. The scope of the present invention is provided in the claims as attached.

The experimental data in the examples are determined by the following equipments and measurement methods:

1. The diameter and length of the metal short fibers are measured as follows: after removal of the polymer matrix from the composite fiber by using a chemical solvent, they are observed and determined by an environmental scanning electron microscope (XL-30 field emission environmental scanning electron microscope, manufactured by the company FEI, US).
2. The test standard for the tensile strength at break and the elongation at break of the composite fiber is GB/T 14337-2008.
3. Method for testing the volume resistivity of the composite fiber is as follows. 1. Composite fiber having a length of about 2 cm is selected, foils of the metal aluminum are adhered with a conductive adhesive tape at the two ends as test electrodes, and the length t of the composite fiber between the inner ends of the electrodes is measured. 2. The diameter d of the composite fiber is measured using an optical microscope. 3. The volume resistance $R_v$ of the fiber is measured by the PC-68 high resistance meter of Shanghai Precision Instruments Corporation. 4. The volume resistivity $\rho_v$ of the fiber test sample is calculated according to the formula $$\rho_v = R_v \cdot \frac{\pi \cdot d^2}{4t}.$$

Ten fibers are measured to obtain an average value.

Example 1

The present example used polypropylene (Sinopec Ningbo Zhenhai Refining & Chemicals, brand Z30S, melting point of 167° C.) as the polymer, tin-bismuth alloy (Beijing Sanhe Dingxin Hi-tech Development Co., Ltd., melting point of 138° C.) as the metal alloy, and carbon nanotubes (Beijing Cnano Technology, brand FT-9000, average diameter of 11 nm, average length of 10 μm, multi-walled carbon nanotubes). The volume ratio of tin-bismuth alloy to polypropylene was 0.5:100, and the weight ratio of carbon nanotubes to polypropylene was 2:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, the carbon nanotubes and the metal alloy in the above proportions were mixed homogeneously in a high speed stirrer, Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer (RH70 model capillary rheometer from Malvern, United Kingdom) and spun at 200° C. to obtain composite precursor fibers, wherein the plunger speed was 5 mm/min, and the winding speed was 60 m/min. The composite precursor fibers were drawn at 150° C. (3326 model universal material testing machine from the company INSTRON, US) to 5 times the original length to obtain polymer/carbon nanotube/metal composite fibers. Various tests were conducted. The test results are listed in Table 1.

As observed with the scanning electron microscope, the diameter of the metal short fibers in the composite fibers was below 1.87 μm. The length was greater than or equal to 6 μm. Broken fibers were rarely seen during spinning, and the fibers as obtained had smooth surface.

Example 2

This example was carried out as described in Example 1, except that the volume ratio of the metal alloy to the polymer was 1:100. The resultant polymer/carbon nanotube/metal composite fibers were subjected to various tests. The test results are listed in Table 1. As observed with the scanning electron microscope, the diameter of the metal short fibers in the composite fibers was below 2.15 μm. The length was greater than or equal to 7.6 μm. Broken fibers were rarely seen during spinning, and the fibers as obtained had smooth surface.

Example 3

This example was carried out as described in Example 1, except that the volume ratio of the metal alloy to the polymer was 2:100. The resultant polymer/carbon nanotube/metal composite fibers were subjected to various tests. The test results are listed in Table 1 and Table 2. As observed with the scanning electron microscope, the diameter of the metal short fibers in the composite fibers was below 3.46 μm. The length was greater than or equal to 9 μm. Broken fibers were rarely seen during spinning, and the fibers as obtained had smooth surface.

Comparative Example 1

This comparative example was carried out as described in Example 1, except that metal alloy was not added. The resultant polypropylene/carbon nanotube fibers were subjected to various tests. The test results are listed in Table 1 and Table 2. A large number of broken fibers were seen during spinning, and the fibers as obtained had rough surface.

Example 4

This example was carried out as described in Example 3, except that the composite precursor fibers were drawn at 150° C. to 10 times the original length. The resultant polymer/carbon nanotube/metal composite fibers were subjected to various tests. The test results are listed in Table 1 and Table 2. As observed with the scanning electron microscope, the diameter of the metal short fibers in the composite fibers was below 1.45 μm. The length was greater than or equal to 9 μm. Broken fibers were rarely seen during spinning, and the fibers as obtained had smooth surface.

Comparative Example 2

This comparative example was carried out as described in Example 4, except that the metal alloy was not added. The resultant polypropylene/carbon nanotube fibers were subjected to various tests. The test results are listed in Table 1 and Table 2. A large number of broken fibers were seen during spinning, and the fibers as obtained had rough surface.

Example 5

This example was carried out as described in Example 3, except that the composite precursor fibers were drawn at 150° C. to 15 times the original length. The resultant polypropylene/carbon nanotube/metal composite fibers were subjected to various tests. The test results are listed in Table 1 and Table 2. As observed with the scanning electron microscope, the diameter of the metal short fibers in the composite fibers was below 0.8 μm. The length was greater than or equal to 6 μm. Broken fibers were rarely seen during spinning, and the fibers as obtained had smooth surface.

Comparative Example 3

This comparative example was carried out as described in Example 5, except that the metal alloy was not added. The resultant polypropylene/carbon nanotube fibers were subjected to various tests. The test results are listed in Table 1 and Table 2. A large number of broken fibers were seen during spinning, and the fibers as obtained had rough surface.

Example 6

This example was carried out as described in Example 3, except that the weight ratio of the carbon nanotubes to the polypropylene was 1:100. The resultant polymer/carbon nanotube/metal composite fibers were subjected to various tests. The test results are listed in Table 1.

As observed with the scanning electron microscope, the diameter of the metal short fibers in the composite fibers was below 2.46 μm. The length was greater than or equal to 5 μm. Broken fibers were rarely seen during spinning, and the fibers as obtained had smooth surface.

Example 7

This example was carried out as described in Example 3, except that the weight ratio of the carbon nanotubes to the polypropylene was 4:100. The resultant polymer/carbon nanotube/metal composite fibers were subjected to various tests. The test results are listed in Table 1.

As observed with the scanning electron microscope, the diameter of the metal short fibers in the composite fibers was below 1.46 μm. The length was greater than or equal to 7 μm. Broken fibers were rarely seen during spinning, and the fibers as obtained had smooth surface.

Comparative Example 4

This comparative example was carried out as described in Example 6, except that the metal alloy was not added. The resultant polypropylene/carbon nanotube fibers were subjected to various tests. The test results are listed in Table 1. A large number of broken fibers were seen during spinning, and the fibers as obtained had rough surface.

Example 8

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and nano titanium dioxide (titanium dioxide FT-3000 from Japan Ishihara, average diameter of 270 nm and average length of 5.15 μm). The volume ratio of the tin-bismuth alloy to the polypropylene was 2:100, and the weight ratio of titanium dioxide to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, titanium dioxide and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/titanium dioxide/metal composite fibers. Various tests were conducted. The test results are listed in Table 1. As observed with the scanning electron microscope, the diameter of the metal short fibers in the composite fibers was below 2.46 μm. The length was greater than or equal to 5.9 μm. Broken fibers were rarely seen during spinning, and the fibers as obtained had smooth surface.

Comparative Example 5

This comparative example was carried out as described in Example 8, except that the metal alloy was not added. The resultant polypropylene/titanium dioxide fibers were subjected to various tests. The test results are listed in Table 1. A large number of broken fibers were seen during spinning, and the fibers as obtained had rough surface.

Example 9

This example was carried out as described in Example 8, except that the weight ratio of the titanium dioxide to the polypropylene was 30:100. The resultant polymer/titanium dioxide/metal composite fibers were subjected to various tests. The test results are listed in Table 1. As observed with the scanning electron microscope, the diameter of the metal short fibers in the composite fibers was below 4.66 μm. The length was greater than or equal to 5.3 μm. Broken fibers were rarely seen during spinning, and the fibers as obtained had smooth surface.

Comparative Example 6

This comparative example was carried out as described in Example 9, except that the metal alloy was not added. The resultant polypropylene/titanium dioxide fibers were subjected to various tests. The test results are listed in Table 1. A large number of broken fibers were seen during spinning, and the fibers as obtained had rough surface.

Example 10

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and nano titanium dioxide (titanium dioxide FT-3000 from Japan Ishihara, average diameter of 270 nm and average length of 5.15 μm). The volume ratio of tin-bismuth alloy to the polypropylene was 1:100, and the weight ratio of titanium dioxide to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, titanium dioxide and metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 5 times the original length to obtain polymer/titanium dioxide/metal composite fibers. Various tests were conducted. The test results are listed in Table 1. As observed with the scanning electron microscope, the diameter of the metal short fibers in the composite fibers was below 4.46 μm. The length was greater than or equal to 5 μm. Broken fibers were rarely seen during spinning, and the fibers as obtained had smooth surface.

Comparative Example 7

This comparative example was carried out as described in Example 10, except that the metal alloy was not added. The resultant polypropylene/titanium dioxide fibers were subjected to various tests. The test results are listed in Table 1. A large number of broken fibers were seen during spinning, and the fibers as obtained had rough surface.

Example 11

This example was carried out as described in Example 10, except that the weight ratio of the titanium dioxide to the polypropylene was 30:100. The resultant polymer/titanium dioxide/metal composite fibers were subjected to various tests. The test results are listed in Table 1. As observed with the scanning electron microscope, the diameter of the metal short fibers in the composite fibers was below 4.66 μm. The length was greater than or equal to 5 μm. Broken fibers were rarely seen during spinning, and the fibers as obtained had smooth surface.

Comparative Example 8

This comparative example was carried out as described in Example 11, except that the metal alloy was not added. The resultant polypropylene/titanium dioxide fibers were subjected to various tests. The test results are listed in Table 1. A large number of broken fibers were seen during spinning, and the fibers as obtained had rough surface.

Example 12

The present example used polypropylene (Sinopec Ningbo Zhenhai Refining & Chemicals, brand Z30S, melting point of 167° C.) the polymer, tin-bismuth alloy (melting point of 138° C.) as the metal alloy, and silver powder (Ningbo Jingxin Electronic Materials Co., Ltd., a high-density spherical silver powder, average particle size of 500 nm, melting point of 960° C.). The volume ratio of the tin-bismuth alloy to the polypropylene was 2:100, and the weight ratio of the silver powder to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, silver powder and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/silver powder/metal composite fibers. Various tests were conducted. The test results are listed in Table 1. As observed with the scanning electron microscope, the diameter of the metal short fibers in the composite fibers was below 3.46 μm. The length was greater than or equal to 7.0 μm. Broken fibers were rarely seen during spinning, and the fibers as obtained had smooth surface.

Comparative Example 9

This comparative example was carried out as described in Example 12, except that the metal alloy was not added. The resultant polypropylene/silver powder fibers were subjected to various tests. The test results are listed in Table 1. A large number of broken fibers were seen during spinning, and the fibers as obtained had rough surface.

Example 13

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and silver powder (Ningbo Jingxin Electronic Materials Co., Ltd., a high-density spherical silver powder, average particle size of 500 nm, melting point of 960° C.). The volume ratio of tin-bismuth alloy to the polypropylene was 1:100, and the weight ratio of silver powder to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, silver powder and the metal alloy in the above proportions were mixed homogeneously in a high speed stirrer, and then they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 5 times the original length to obtain polymer/silver powder/metal composite fibers. Various tests were conducted. The test results are listed in Table 1. As observed with the scanning electron microscope, the diameter of the metal short fibers in the composite fibers was below 3.46 μm. The length was greater than or equal to 7 μm. Broken fibers were rarely seen during spinning, and the fibers as obtained had smooth surface.

Comparative Example 10

This comparative example was carried out as described in Example 13, except that the metal alloy was not added. The resultant polypropylene/silver powder fibers were subjected to various tests. The test results are listed in Table 1. A large number of broken fibers were seen during spinning, and the fibers as obtained had rough surface.

Example 14

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and stainless steel fibers (Beijing Jinfubang Co. Ltd., chopped fibers, average diameter of 8 μm, melting point 1350° C.). The volume ratio of tin-bismuth alloy to the polypropylene was 2:100, and the weight ratio of the stainless steel fibers to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, stainless steel and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/stainless steel/metal composite fibers. Various tests were conducted. The test results are listed in Table 1. As observed with the scanning electron microscope, the diameter of the metal short fibers in the composite fibers was below 2.46 μm. The length was greater than or equal to 8.0 μm. Broken fibers were rarely seen during spinning, and the fibers as obtained had smooth surface.

Comparative Example 11

This comparative example was carried out as described in Example 14, except that the metal alloy was not added. The resultant polypropylene/stainless steel fiber-composite fibers were subjected to various tests. The test results are listed in Table 1. A large number of broken fibers were seen during spinning, and the fibers as obtained had rough surface.

Example 15

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and stainless steel fibers (Beijing Jinfubang Co. Ltd, chopped fibers, average diameter of 8 μm, melting point 1350° C.). The volume ratio of tin-bismuth alloy to the polypropylene was 1:100, and the weight ratio of stainless steel fibers to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, stainless steel and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 5 times the original length to obtain polymer/stainless steel/metal composite fibers. Various tests were conducted. The test results are listed in Table 1. As observed with the scanning electron microscope, the diameter of the metal short fibers in the composite fibers was below 7.46 μm. The length was greater than or equal to 7 μm. Broken fibers were rarely seen during spinning, and the fibers as obtained had smooth surface.

Comparative Example 12

This comparative example was carried out as described in Example 15, except that the metal alloy was not added. The resultant polypropylene/stainless steel fiber-composite fibers were subjected to various tests. The test results are listed in Table 1. A large number of broken fibers were seen during spinning, and the fibers as obtained had rough surface.

Example 16

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and polyaniline (Tianjin Dewangmaite New Materials Technology Co. Ltd., polyaniline nanowires with an average diameter of 100 nm, and an average length of 10 μm). The volume ratio of tin-bismuth alloy to the polypropylene was 2:100, and the weight ratio of the polyaniline to the polypropylene was 10:100. Antioxidant 1010 (produced by Ciba-Geigy, SWITZERLAND), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, the polyaniline and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/polyaniline/metal composite fibers. Various tests were conducted. The test results are listed in Table 1. As observed with the scanning electron microscope, the diameter of the metal short fibers in the composite fibers was below 3.46 μm. The length was greater than or equal to 7.5 μm. Broken fibers were rarely seen during spinning.

Comparative Example 13

This comparative example was carried out as described in Example 16, except that the metal alloy was not added. The resultant polypropylene/polyaniline fibers were subjected to various tests. The test results are listed in Table 1. A large number of broken fibers were seen during spinning.

Example 17

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and polyaniline (Tianjin Dewangmaite New Materials Technology Co. Ltd., polyaniline nanowires with an average diameter of 100 nm, and an average length of 10 μm). The volume ratio of tin-bismuth alloy to the polypropylene was 1:100, and the weight ratio of the polyaniline to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, polyaniline and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 5 times the original length to obtain polymer/polyaniline/metal composite fibers. Various tests were conducted. The test results are listed in Table 1. As observed with the scanning electron microscope, the diameter of the metal short fibers in the composite fibers was below 6.46 μm. The length was greater than or equal to 5 μm. Broken fibers were rarely seen during spinning.

Comparative Example 14

This comparative example was carried out as described in Example 17, except that the metal alloy was not added. The resultant polypropylene/polyaniline fibers were subjected to various tests. The test results are listed in Table 1. A large number of broken fibers were seen during spinning.

Example 18

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and montmorillonite (NanoCor, US, brand I.44PSS). The volume ratio of the tin-bismuth alloy to the polypropylene was 2:100, and the weight ratio of montmorillonite to the polypropylene was 2:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, montmorillonite and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/montmorillonite/metal composite fibers. Various tests were conducted. The test results are listed in Table 1.

As observed with the scanning electron microscope, the diameter of the metal short fibers in the composite fibers was below 1.46 μm. The length was greater than or equal to 6.5 μm. Broken fibers were rarely seen during spinning, and the fibers as obtained had smooth surface.

Comparative Example 15

This comparative example was carried out as described in Example 18, except that the metal alloy was not added. The resultant polypropylene/montmorillonite fibers were subjected to various tests. The test results are listed in Table 1. A large number of broken fibers were seen during spinning, and the fibers as obtained had rough surface.

Example 19

The present example used polypropylene (Sinopec Ningbo Zhenhai Refining & Chemicals, brand Z30S, melting point of 167° C.) as the polymer, tin-bismuth alloy (Beijing Sanhe Dingxin Hi-tech Development Co., Ltd., melting point of 138° C.) as the metal alloy, and montmorillonite (NanoCor, US, brand I.44PSS). The volume ratio of tin-bismuth alloy to the polypropylene was 0.5:100, and the weight ratio of montmorillonite to the polypropylene was 2:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, montmorillonite and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/montmorillonite/metal composite fibers. Various tests were conducted. The test results are listed in Table 1.

As observed with the scanning electron microscope, the diameter of the metal short fibers in the composite fibers was below 1.06 μm. The length was greater than or equal to 7.5 μm. Broken fibers were rarely seen during spinning, and the fibers as obtained had smooth surface.

Example 20

This example was carried out as described in Example 19, except that the volume ratio of the metal alloy to the polymer was 1:100. The resultant polymer/montmorillonite/metal composite fibers were subjected to various tests. The test results are listed in Table 1.

As observed with the scanning electron microscope, the diameter of the metal short fibers in the composite fibers was below 2.15 μm. The length was greater than or equal to 7.5 μm. Broken fibers were rarely seen during spinning, and the fibers as obtained had smooth surface.

Example 21

This example was carried out as described in Example 18, except that composite precursor fibers were drawn at 150° C. to 5 times the original length. The resultant polymer/montmorillonite/metal composite fibers were subjected to various tests. The test results are listed in Table 1.

As observed with the scanning electron microscope, the diameter of the metal short fibers in the composite fibers was below 3.01 μm. The length was greater than or equal to 6.5

μm. Broken fibers were rarely seen during spinning, and the fibers as obtained had smooth surface.

Comparative Example 16

This comparative example was carried out as described in Example 21, except that the metal alloy was not added. The resultant polypropylene/montmorillonite fibers were subjected to various tests. The test results are listed in Table 1. A large number of broken fibers were seen during spinning, and the fibers as obtained had rough surface.

Example 22

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and siloxane-modified montmorillonite (NanoCor, US, brand I.44PSS). The volume ratio of tin-bismuth alloy to the polypropylene was 0.5:100, and the weight ratio of montmorillonite to the polypropylene was 2:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, montmorillonite and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 5 times the original length to obtain polymer/montmorillonite/metal composite fibers. Various tests were conducted. The test results are listed in Table 1.

As observed with the scanning electron microscope, the diameter of the metal short fibers in the composite fibers was below 1.66 μm. The length was greater than or equal to 5.5 μm. Broken fibers were rarely seen during spinning, and the fibers as obtained had smooth surface.

Example 23

This example was carried out as described in Example 22, except that the volume ratio of the metal alloy to the polymer was 1:100. The resultant polymer/montmorillonite/metal composite fibers were subjected to various tests. The test results are listed in Table 1.

As observed with the scanning electron microscope, the diameter of the metal short fibers in the composite fibers was below 2.45 μm. The length was greater than or equal to 6.5 μm. Broken fibers were rarely seen during spinning, and the fibers as obtained had smooth surface.

Example 24

This example was carried out as described in Example 21, except that composite precursor fibers were drawn at 150° C. to 10 times the original length. The resultant polymer/montmorillonite/metal composite fibers were subjected to various tests. The test results are listed in Table 1.

As observed with the scanning electron microscope, the diameter of the metal short fibers in the composite fibers was below 1.67 μm. The length was greater than or equal to 8.5 μm. Broken fibers were rarely seen during spinning, and the fibers as obtained had smooth surface.

Comparative Example 17

This comparative example was carried out as described in Example 24, except that the metal alloy was not added. The resultant polypropylene/montmorillonite fibers were subjected to various tests. The test results are listed in Table 1. A large number of broken fibers were seen during spinning, and the fibers as obtained had rough surface.

Example 25

This example was carried out as described in Example 18, except that the weight ratio of the montmorillonite to the polypropylene was 0.5:100. The resultant polymer/montmorillonite/metal composite fibers were subjected to various tests. The test results are listed in Table 1.

As observed with the scanning electron microscope, the diameter of the metal short fibers in the composite fibers was below 0.9 μm. The length was greater than or equal to 7.9 μm. Broken fibers were rarely seen during spinning, and the fibers as obtained had smooth surface.

Comparative Example 18

This comparative example was carried out as described in Example 25, except that the metal alloy was not added. The resultant polypropylene/montmorillonite fibers were subjected to various tests. The test results are listed in Table 1. A large number of broken fibers were seen during spinning, and the fibers as obtained had rough surface.

Example 26

This example was carried out as described in Example 18, except that the weight ratio of the montmorillonite to the polypropylene was 4:100. The resultant polymer/montmorillonite/metal composite fibers were subjected to various tests. The test results are listed in Table 1.

As observed with the scanning electron microscope, the diameter of the metal short fibers in the composite fibers was below 1.09 μm. The length was greater than or equal to 8.5 μm. Broken fibers were rarely seen during spinning, and the fibers as obtained had smooth surface.

Comparative Example 19

This comparative example was carried out as described in Example 26, except that the metal alloy was not added. The resultant polypropylene/montmorillonite fibers were subjected to various tests. The test results are listed in Table 1. A large number of broken fibers were seen during spinning, and the fibers as obtained had rough surface.

Example 27

This example was carried out as described in Example 18, except that the weight ratio of the montmorillonite to the polypropylene was 8:100. The resultant polymer/montmorillonite/metal composite fibers were subjected to various tests. The test results are listed in Table 1.

As observed with the scanning electron microscope, the diameter of the metal short fibers in the composite fibers was below 2.46 μm. The length was greater than or equal to 8.6 μm. Broken fibers were rarely seen during spinning, and the fibers as obtained had smooth surface.

Comparative Example 20

This comparative example was carried out as described in Example 27, except that the metal alloy was not added. The resultant polypropylene/montmorillonite fibers were subjected to various tests. The test results are listed in Table 1. A large number of broken fibers were seen during spinning, and the fibers as obtained had rough surface.

Example 28

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and nano calcium carbonate (Henan Keli, brand NLY-201, particle size in the range of 30-50 nm). The volume ratio of tin-bismuth alloy to the polypropylene was 2:100, and the weight ratio of calcium carbonate to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, calcium carbonate and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/calcium carbonate/metal composite fibers. Various tests were conducted. The test results are listed in Table 1.

As observed with the scanning electron microscope, the diameter of the metal short fibers in the composite fibers was below 2.06 μm. The length was greater than or equal to 7.8 μm. Broken fibers were rarely seen during spinning, and the fibers as obtained had smooth surface.

Comparative Example 21

This comparative example was carried out as described in Example 28, except that the metal alloy was not added. The resultant polypropylene/calcium carbonate fibers were subjected to various tests. The test results are listed in Table 1. A large number of broken fibers were seen during spinning, and the fibers as obtained had rough surface.

Example 29

This example was carried out as described in Example 24, except that the weight ratio of the calcium carbonate to the polypropylene was 30:100. The resultant polymer/calcium carbonate/metal composite fibers were subjected to various tests. The test results are listed in Table 1.

As observed with the scanning electron microscope, the diameter of the metal short fibers in the composite fibers was below 2.09 μm. The length was greater than or equal to 7.5 μm. Broken fibers were rarely seen during spinning, and the fibers as obtained had smooth surface.

Comparative Example 22

This comparative example was carried out as described in Example 29, except that the metal alloy was not added. The resultant polypropylene/calcium carbonate fibers were subjected to various tests. The test results are listed in Table 1. A large number of broken fibers were seen during spinning, and the fibers as obtained had rough surface.

Example 30

The present example used polypropylene (Sinopec Ningbo Zhenhai Refining & Chemicals, brand Z30S, melting point of 167° C.) as the polymer, tin-bismuth alloy (melting point of 138° C.) as the metal alloy, and calcium sulfate whisker (Zhengzhou Bokaili, brand nano calcium sulfate whisker, average diameter of 500 nm). The volume ratio of tin-bismuth alloy to the polypropylene was 2:100, and the weight ratio of calcium sulfate to the polypropylene was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polypropylene, the amount of antioxidant 1010 was 0.5 part, the amount of antioxidant 168 was 0.5 part, and the amount of zinc stearate was 1 part.

The above raw materials of the polymer, calcium sulfate and the metal alloy in the above proportions were mixed homogeneously in a high speed stirrer. Then, they were extruded and pelletized using PolymLab twin screw extruder from the company HAAKE, Germany, with temperatures of the various zones of the extruder being: 190° C., 200° C., 210° C., 210° C., 210° C., and 200° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 150° C. to 15 times the original length to obtain polymer/calcium sulfate/metal composite fibers. Various tests were conducted. The test results are listed in Table 1.

As observed with the scanning electron microscope, the diameter of the metal short fibers in the composite fibers was below 3.06 μm. The length was greater than or equal to 8 μm. Broken fibers were rarely seen during spinning, and the fibers as obtained had smooth surface.

Comparative Example 23

This comparative example was carried out as described in Example 30, except that the metal alloy was not added. The resultant polypropylene/calcium sulfate fibers were subjected to various tests. The test results are listed in Table 1. A large number of broken fibers were seen during spinning, and the fibers as obtained had rough surface.

Example 31

The present example used polyamide 11 (Arkema, France, brand Natural D40, melting point of 179° C.) as the polymer, tin-bismuth alloy (melting point of 138° C.) as the metal alloy, and carbon nanotubes (Beijing Cnano Technology, brand FT-9000, average diameter of 11 nm, average length of 10 μm, multi-walled carbon nanotubes). The volume ratio of the metal alloy to the polymer was 2:100, and the weight ratio of carbon nanotubes to the polymer was 2:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polyamide 11, the amount of antioxidant 1010 was 0.5 part, the amount of antioxidant 168 was 0.5 part, and the amount of zinc stearate was 1 part.

The above raw materials of the polymer, carbon nanotubes and the metal alloy in the above proportions were mixed homogeneously in a high speed stirrer. Then, they were extruded and pelletized using PolymLab twin screw extruder from the company HAAKE, Germany, with temperatures of the various zones of the extruder being: 200° C., 210° C., 220° C., 220° C., 220° C., and 210° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 170° C. to 15 times the original length to obtain polymer/carbon nanotube/metal composite fibers. Various tests were conducted. The test results are listed in Table 1.

As observed with the scanning electron microscope, the diameter of the metal short fibers in the composite fibers was below 1.40 μm. The length was greater than or equal to 8.1 μm. Broken fibers were rarely seen during spinning, and the fibers as obtained had smooth surface.

Comparative Example 24

This comparative example was carried out as described in Example 31, except that the metal alloy was not added. The test results for the polyamide/carbon nanotube fibers are listed in Table 1. A large number of broken fibers were seen during spinning, and the fibers as obtained had rough surface.

Example 32

The present example used polyamide 11 (Arkema, France, brand Natural D40, melting point of 179° C.) as the polymer, tin-bismuth alloy (melting point of 138° C.) as the metal alloy, and siloxane-modified montmorillonite (NanoCor, US, brand I.44PSS). The volume ratio of the metal alloy to the polymer was 2:100, and the weight ratio of montmorillonite to the polymer was 2:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polyamide 11, the amount of antioxidant 1010 was 0.5 part, the amount of antioxidant 168 was 0.5 part, and the amount of zinc stearate was 1 part.

The above raw materials of the polymer, montmorillonite and the metal alloy in the above proportions were mixed homogeneously in a high speed stirrer. Then, they were extruded and pelletized using PolymLab twin screw extruder from the company HAAKE, Germany, with temperatures of the various zones of the extruder being: 200° C., 210° C., 220° C., 220° C., 220° C., and 210° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 170° C. to 15 times the original length to obtain polymer/montmorillonite/metal composite fibers. Various tests were conducted. The test results are listed in Table 1.

As observed with the scanning electron microscope, the diameter of the metal short fibers in the composite fibers was below 1.90 μm. The length was greater than or equal to 5.1 μm. Broken fibers were rarely seen during spinning, and the fibers as obtained had smooth surface.

Comparative Example 25

This comparative example was carried out as described in Example 32, except that the metal alloy was not added. The test results for the polyamide/montmorillonite fibers are listed in Table 1. A large number of broken fibers were seen during spinning, and the fibers as obtained had rough surface.

Example 33

This example was carried out as described in Example 32, except that the siloxane-modified montmorillonite was replaced with sodium based non-modified pure montmorillonite (Zhejiang Fenghong New Materials Co., Ltd.). The test results for the polyamide/montmorillonite/metal fibers are listed in Table 1.

As observed with the scanning electron microscope, the diameter of the metal short fibers in the composite fibers was below 2.50 μm. The length was greater than or equal to 4.51 μm. Broken fibers were rarely seen during spinning, and the fibers as obtained had smooth surface.

Comparative Example 26

This comparative example was carried out as described in Example 33, except that the metal alloy was not added. The test results for the polyamide/montmorillonite fibers are listed in Table 1. A large number of broken fibers were seen during spinning, and the fibers as obtained had rough surface.

Example 34

The present example used polyamide 11 (Arkema, France, brand Natural D40, melting point of 179° C.) as the polymer, tin-bismuth alloy (melting point of 138° C.) as the metal alloy, and nano titanium dioxide (titanium dioxide FT-3000 from Japan Ishihara, average diameter of 270 nm and average length of 5.15 μm). The volume ratio of the metal alloy to the polymer was 2:100, and the weight ratio of titanium dioxide to the polymer was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polyamide 11, the amount of antioxidant 1010 was 0.5 part, the amount of antioxidant 168 was 0.5 part, and the amount of zinc stearate was 1 part.

The above raw materials of the polymer, titanium dioxide and the metal alloy in the above proportions were mixed homogeneously in a high speed stirrer. Then, they were extruded and pelletized using PolymLab twin screw extruder from the company HAAKE, Germany, with temperatures of the various zones of the extruder being: 200° C., 210° C., 220° C., 220° C., 220° C., and 210° C. (die temperature).

The pellets were added to a capillary rheometer and spun at 200° C. to obtain composite precursor fibers, wherein the plunger speed was 5 mm/min, and the winding speed was 60 m/min. The composite precursor fibers were drawn at 170° C. to 15 times the original length to obtain polymer/titanium dioxide/metal composite fibers. Various tests were conducted. The test results are listed in Table 1.

As observed with the scanning electron microscope, the diameter of the metal short fibers in the composite fibers was below 1.30 μm. The length was greater than or equal to 7.1 μm. Broken fibers were rarely seen during spinning, and the fibers as obtained had smooth surface.

Comparative Example 27

This comparative example was carried out as described in Example 34, except that the metal alloy was not added. The test results for the polyamide/titanium dioxide fibers are listed in Table 1. A large number of broken fibers were seen during spinning, and the fibers as obtained had rough surface.

Example 35

The present example used polyamide 11 (Arkema, France, brand Natural D40, melting point of 179° C.) as the polymer, tin-bismuth alloy (melting point of 138° C.) as the metal alloy, and nano calcium carbonate (Henan Keli, brand NLY-201, particle size in the range of from 30 to 50 nm). The volume ratio of the metal alloy to the polymer was 2:100, and the weight ratio of calcium carbonate to the polymer was 10:100. Antioxidant 1010 (produced by Ciba-Geigy, Switzerland), antioxidant 168 (produced by Ciba-Geigy, Switzerland), and zinc stearate (commercially available) were added in appropriate amounts; wherein based on 100 parts by weight of the polyamide 11, the amount of antioxidant 1010 was 0.5 part, the amount of antioxidant 168 was 0.5 part, and the amount of zinc stearate was 1 part.

The above raw materials of the polymer, calcium carbonate and the metal alloy in the above proportions were mixed homogeneously in a high speed stirrer. Then, they were extruded and pelletized using PolymLab twin screw extruder from the company HAAKE, Germany, with temperatures of the various zones of the extruder being: 200° C., 210° C., 220° C., 220° C., 220° C., and 210° C. (die temperature). The pellets were added to a capillary rheometer and spun at 200° C. to obtain composite precursor fibers, wherein the plunger speed was 5 mm/min, and the winding speed was 60 m/min. The composite precursor fibers were drawn at 170° C. to 15 times the original length to obtain polymer/calcium carbonate/metal composite fibers. Various tests were conducted. The test results are listed in Table 1.

As observed with the scanning electron microscope, the diameter of the metal short fibers in the composite fibers was below 1.50 μm. The length was greater than or equal to 7.1 μm. Broken fibers were rarely seen during spinning, and the fibers as obtained had smooth surface.

Comparative Example 28

This comparative example was carried out as described in Example 35, except that the metal alloy was not added. The test results for the polyamide/calcium carbonate fibers are listed in Table 1. A large number of broken fibers were seen during spinning, and the fibers as obtained had rough surface.

TABLE 1

| Sample No. | Volume resistivity (Ω · cm) | Sample No. | Volume resistivity (Ω · cm) |
|---|---|---|---|
| Ex. 1 | $9 \times 10^{11}$ | Comp. Ex. 1 | $4 \times 10^{12}$ |
| Ex. 2 | $3 \times 10^{11}$ | | |
| Ex. 3 | $1.15 \times 10^{11}$ | | |
| Ex. 4 | $3.48 \times 10^{10}$ | Comp. Ex. 2 | $9 \times 10^{13}$ |
| Ex. 5 | $9 \times 10^{9}$ | Comp. Ex. 3 | $2 \times 10^{14}$ |
| Ex. 6 | $8 \times 10^{11}$ | Comp. Ex. 4 | $1 \times 10^{13}$ |
| Ex. 7 | $6 \times 10^{9}$ | | |
| Ex. 8 | $5 \times 10^{10}$ | Comp. Ex. 5 | $5 \times 10^{15}$ |
| Ex. 9 | $9 \times 10^{9}$ | Comp. Ex. 6 | $2 \times 10^{15}$ |
| Ex. 10 | $5 \times 10^{10}$ | Comp. Ex. 7 | $5 \times 10^{15}$ |
| Ex. 11 | $9 \times 10^{9}$ | Comp. Ex. 8 | $2 \times 10^{15}$ |
| Ex. 12 | $6 \times 10^{11}$ | Comp. Ex. 9 | $6 \times 10^{15}$ |
| Ex. 13 | $6 \times 10^{11}$ | Comp. Ex. 10 | $6 \times 10^{15}$ |
| Ex. 14 | $5.6 \times 10^{10}$ | Comp. Ex. 11 | $8 \times 10^{15}$ |
| Ex. 15 | $5.6 \times 10^{10}$ | Comp. Ex. 12 | $8 \times 10^{15}$ |
| Ex. 16 | $6.5 \times 10^{10}$ | Comp. Ex. 13 | $4 \times 10^{15}$ |
| Ex. 17 | $6.5 \times 10^{10}$ | Comp. Ex. 14 | $4 \times 10^{15}$ |
| Ex. 18 | $6 \times 10^{11}$ | Comp. Ex. 15 | $4.0 \times 10^{16}$ |
| Ex. 19 | $9.6 \times 10^{11}$ | | |
| Ex. 20 | $8 \times 10^{11}$ | | |
| Ex. 21 | $4 \times 10^{13}$ | Comp. Ex. 16 | $2 \times 10^{16}$ |
| Ex. 22 | $9 \times 10^{13}$ | | |
| Ex. 23 | $7 \times 10^{13}$ | | |
| Ex. 24 | $2.2 \times 10^{12}$ | Comp. Ex. 17 | $1.8 \times 10^{16}$ |
| Ex. 25 | $3 \times 10^{12}$ | Comp. Ex. 18 | $1.8 \times 10^{16}$ |
| Ex. 26 | $5 \times 10^{11}$ | Comp. Ex. 19 | $1.4 \times 10^{16}$ |
| Ex. 27 | $1 \times 10^{11}$ | Comp. Ex. 20 | $1.3 \times 10^{16}$ |
| Ex. 28 | $7 \times 10^{11}$ | Comp. Ex. 21 | $3 \times 10^{16}$ |
| Ex. 29 | $2 \times 10^{11}$ | Comp. Ex. 22 | $2.3 \times 10^{16}$ |
| Ex. 30 | $9 \times 10^{11}$ | Comp. Ex. 23 | $5 \times 10^{16}$ |
| Ex. 31 | $8 \times 10^{9}$ | Comp. Ex. 24 | $5 \times 10^{15}$ |
| Ex. 32 | $9 \times 10^{10}$ | Comp. Ex. 25 | $9 \times 10^{15}$ |
| Ex. 33 | $1.2 \times 10^{11}$ | Comp. Ex. 26 | $8 \times 10^{15}$ |
| Ex. 34 | $6 \times 10^{11}$ | Comp. Ex. 27 | $4.0 \times 10^{16}$ |
| Ex. 35 | $9 \times 10^{10}$ | Comp. Ex. 28 | $8 \times 10^{14}$ |

TABLE 2

| variance in draw ratio | | |
|---|---|---|
| Sample No. | Tensile strength at break (CN/dtex) | Elongation at break (%) |
| Ex. 3 | 2.63 | 37.8 |
| Comp. Ex. 1 | 2.51 | 36.46 |
| Ex. 4 | 4.7 | 20.7 |
| Comp. Ex. 2 | 4.4 | 19.1 |
| Ex. 5 | 6.1 | 19.7 |
| Comp. Ex. 3 | 5.16 | 17.5 |

As can be seen from the data in Table 2, with respect to the polymer/filler composite fibers containing no low melting point metal, the corresponding polymer/filler/low melting point metal composite fibers of the present invention had greater tensile strength and greater elongation at break at the same draw ratio of precursor fibers. These data showed that with respect to the polymer/filler composite fibers, the addition of a small amount of low melting point metal can achieve simultaneous increase in the tensile strength at break, elongation at break and the volume resistivity of the polymer/filler/metal composite fibers.

What is claimed:

1. A polymer/filler/metal composite fiber, including a polymer fiber comprising a metal short fiber and a filler, and having the microstructure that the metal short fiber is distributed as a dispersed phase within the polymer fiber, the metal short fiber as the dispersed phase is distributed in parallel to the axis of the polymer fiber, and the filler is dispersed within the polymer fiber and is distributed between metal short fibers, wherein:

the polymer is a thermoplastic resin, the filler does not melt at the processing temperature of the polymer, metal in the metal short fiber is a low melting point metal and at least one selected from a group consisting of single component metals and metal alloys, and has a melting point which ranges from 20 to 480° C. and at the same time is lower than the processing temperature of the polymer, the metal short fiber is non-continuous, has a length shorter than that of the polymer fiber, and has a diameter of less than or equal to 12 μm, and the volume ratio of the metal short fiber to the polymer fiber is in the range of from 0.01:100 to 4:100.

2. The polymer/filler/metal composite fiber according to claim 1, characterized in that the volume ratio of the metal short fiber to the polymer fiber is in the range of from 0.1:100 to 4:100.

3. The polymer/filler/metal composite fiber according to claim 1, characterized in that the metal has a melting point in the range of from 100 to 250° C.

4. The polymer/filler/metal composite fiber according to claim 1, characterized in that the single component metal as the metal is the elemental metal selected from a group consisting of gallium, cesium, rubidium, indium, tin, bismuth, cadmium, and lead elements; and the metal alloy as the metal is the metal alloy formed by two or more elements selected from a group consisting of gallium, cesium, rubidium, indium, tin, bismuth, cadmium and lead elements;

or the metal alloy formed by at least one element selected from a group consisting of gallium, cesium, rubidium, indium, tin, bismuth, cadmium and lead elements and at least one element selected from a group consisting of copper, silver, gold, iron and zinc elements;

or the alloy formed by at least one element selected from a group consisting of gallium, cesium, rubidium, indium, tin, bismuth, cadmium and lead elements, at least one element selected from a group consisting of copper, silver, gold, iron, and zinc elements, and at least one element selected from a group consisting of silicon element and carbon element.

5. The polymer/filler/metal composite fiber according to claim 1, characterized in that the polymer is the thermoplastic resin having a melting point in the range of from 90 to 450° C.

6. The polymer/filler/metal composite fiber according to claim 5, characterized in that the polymer is selected from a group consisting of polyethylene, polypropylene, polyamide and polyester.

7. The polymer/filler/metal composite fiber according to claim 1, characterized in that the weight ratio of the filler to the polymer is in the range of from 0.1:100 to 30:100.

8. The polymer/filler/metal composite fiber according to claim 1, characterized in that the filler has at least one dimension of the three dimensions less than 500 μm.

9. The polymer/filler/metal composite fiber according to claim 1, characterized in that the filler is a non-conductive filler and/or a conductive filler.

10. The polymer/filler/metal composite fiber according to claim 9, characterized in that the non-conductive filler is at least one selected from a group consisting of non-conductive metal salts, metal nitrides, nonmetallic nitrides, nonmetallic carbides, metal hydroxides, metal oxides, non-metal oxides, and natural ores.

11. The polymer/filler/metal composite fiber according to claim 9, characterized in that the non-conductive filler is at least one selected from a group consisting of calcium carbonate, barium sulfate, calcium sulfate, silver chloride, aluminum hydroxide, magnesium hydroxide, alumina, magnesia, silica, asbestos, talc, kaolin, mica, feldspar, wollastonite and montmorillonite.

12. The polymer/filler/metal composite fiber according to claim 11, characterized in that the montmorillonite is at least one selected from a group consisting of a non-modified pure montmorillonite and an organically modified montmorillonite.

13. The polymer/filler/metal composite fiber according to claim 12, characterized in that the organically modified montmorillonite is at least one selected from a group consisting of an organic quaternary ammonium salt modified montmorillonite, a quaternary phosphonium salt modified montmorillonite, silicone-modified montmorillonite, siloxane-modified montmorillonite, and amine modified montmorillonite.

14. The polymer/filler/metal composite fiber according to claim 9, characterized in that the conductive filler is at least one selected from a group consisting of single component metals, metal alloys, metal oxides, metal salts, metal nitrides, nonmetallic nitrides, metal hydroxides, conductive polymers, and conductive carbon materials.

15. The polymer/filler/metal composite fiber according to claim 9, characterized in that the conductive filler is at least one selected from a group consisting of gold, silver, copper, iron, gold alloys, silver alloys, copper alloys, iron alloys, titanium dioxide, ferric oxide, ferroferric oxide, silver oxides, zinc oxides, carbon black, carbon nanotubes, graphene and linear conductive polyaniline.

16. The polymer/filler/metal composite fiber according to claim 1, characterized in that the filler is a nanoscale filler.

17. The polymer/filler/metal composite fiber according to claim 16, characterized in that the nanoscale filler has at least one dimension of its three dimensions of less than 100 nm.

18. The polymer/filler/metal composite fiber according to claim 9, characterized in that the conductive filler is at least one selected from a group consisting of single-walled carbon nanotubes, double-walled carbon nanotubes, and multi-walled carbon nanotubes.

19. The polymer/filler/metal composite fiber according to claim 1, characterized in that the composite fiber is prepared by the process comprising the following steps:

step 1: melt blending the components including the polymer, the filler and the metal in given amounts to obtain a polymer/filler/metal blend;

step 2: spinning the polymer/filler/metal blend obtained in step 1 in a spinning device to obtain a polymer/filler/metal composite precursor fiber; and step 3: drawing the polymer/filler/metal composite precursor fiber obtained in step 2 while heating within a range of the temperature lower than the melting point of the polymer used and higher than or equal to the melting point of the low melting point metal used to obtain the polymer/filler/metal composite fiber.

20. The polymer/filler/metal composite fiber according to claim 19, characterized in that the draw ratio of the drawing while heating in step 3 is greater than or equal to 2 times.

21. A process for preparing the polymer/filler/metal composite fiber according to claim 1, comprising the following steps:

step 1: melt blending the components including the polymer, the filler and the metal in given amounts to obtain a polymer/filler/metal blend;

step 2: spinning the polymer/filler/metal blend obtained in step 1 in a spinning device to obtain a polymer/filler/metal composite precursor fiber; and step 3: drawing the polymer/filler/metal composite precursor fiber obtained in step 2 while heating within a range of the temperature lower than the melting point of the polymer used and higher than or equal to the melting point of the low melting point metal used to obtain the polymer/filler/metal composite fiber.

22. The polymer/filler/metal composite fiber according to claim 2, characterized in that the volume ratio of the metal short fiber to the polymer fiber is in the range of from 0.5:100 to 2:100.

23. The polymer/filler/metal composite fiber according to claim 3, characterized in that the metal has a melting point in the range of from 120 to 230° C.

24. The polymer/filler/metal composite fiber according to claim 1, characterized in that the metal short fiber has a diameter of less than or equal to 8 μm.

25. The polymer/filler/metal composite fiber according to claim 1, characterized in that the metal short fiber has a diameter of less than or equal to 3 μm.

26. The polymer/filler/metal composite fiber according to claim 5, characterized in that the polymer is the thermoplastic resin having a melting point in the range of 100 to 290° C.

27. The polymer/filler/metal composite fiber according to claim 7, characterized in that the weight ratio of the filler to the polymer is in the range of from 0.5:100 to 10:100.

28. The polymer/filler/metal composite fiber according to claim 7, characterized in that the weight ratio of the filler to the polymer is in the range of from 1:100 to 2:100.

29. The polymer/filler/metal composite fiber according to claim 8, characterized in that the filler has at least one dimension of the three dimensions less than 300 μm.

30. The polymer/filler/metal composite fiber according to claim 17, characterized in that the nanoscale filler has at least one dimension of its three dimensions of less than 50 nm.

31. The polymer/filler/metal composite fiber according to claim 20, characterized in that the draw ratio of the drawing while heating in step 3 is greater than or equal to 5 times.

32. The polymer/filler/metal composite fiber according to claim 20, characterized in that the draw ratio of the drawing while heating in step 3 is greater than or equal to 10 times.

* * * * *